United States Patent [19]

Rosson

[11] Patent Number: 4,846,467

[45] Date of Patent: Jul. 11, 1989

[54] RACE DRIVER START SIGNAL REACTION TIMER

[76] Inventor: John W. Rosson, P.O. Box 1185, Erick, Okla. 73645

[21] Appl. No.: 124,195

[22] Filed: Nov. 23, 1987

[51] Int. Cl.[4] ..... A63F 9/14; G04F 10/04; G04F 13/02

[52] U.S. Cl. ..... 273/1 GE; 273/86 R; 340/309.15; 340/323 R; 377/112; 377/5; 377/20

[58] Field of Search ..... 340/309.15, 323 R, 576; 273/1 GE, 86 B, 86 F, 86 R; 377/20, 24.1, 112, 5; 328/130.1

[56] References Cited

U.S. PATENT DOCUMENTS

| | | | |
|---|---|---|---|
| 3,877,216 | 4/1975 | Mounce et al. | 340/323 |
| 3,934,240 | 1/1976 | Norling | 340/309.15 |
| 4,075,829 | 2/1978 | Goff | 377/112 |
| 4,093,870 | 6/1978 | Epstein | 340/576 |
| 4,275,292 | 6/1981 | Corbi | 377/24.1 |
| 4,373,722 | 2/1983 | Kite et al. | 273/86 R |
| 4,408,187 | 10/1983 | Rollins | 340/309.15 |
| 4,755,140 | 7/1988 | Rimland | 273/1 GE |

*Primary Examiner*—John S. Heyman
*Attorney, Agent, or Firm*—Robert K. Rhea

[57] ABSTRACT

An electronic drag race starting signal unit includes a housing contained circuit provided with or energizing a series of race starting lamps. The race start indicator or Christmas Tree, which may be a series of LED's, are preferably three aligned amber or yellow lamps terminating in aligned relationship with a red lamp and a green lamp interposed betwen the red lamp and the adjacent yellow lamp. A manually held pushbutton switch, when closed, simulates a vehicle transmission brake and energizes the circuit to sequentially or simultaneously energize the yellow lamps followed by the green lamp which is the start signal. A counter in the circuit visually records the time lapse between the start signal and the release (opening) of the push-button switch by the operator which, if it is received before a predetermined time, energizes the red lamp as a disqualification.

5 Claims, 2 Drawing Sheets

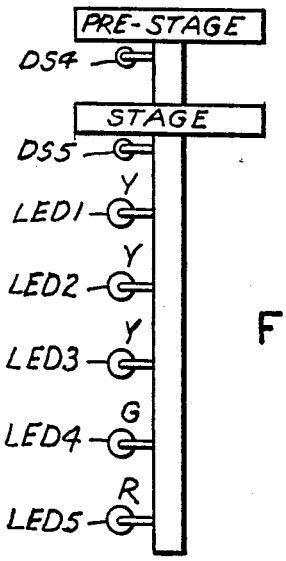
FIG.1
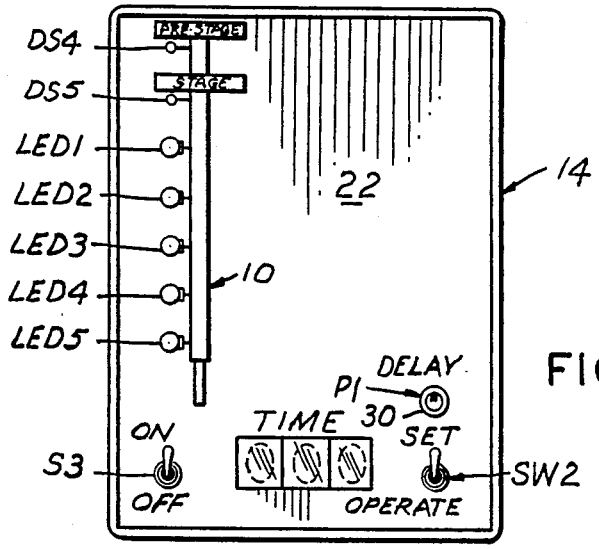
FIG.2
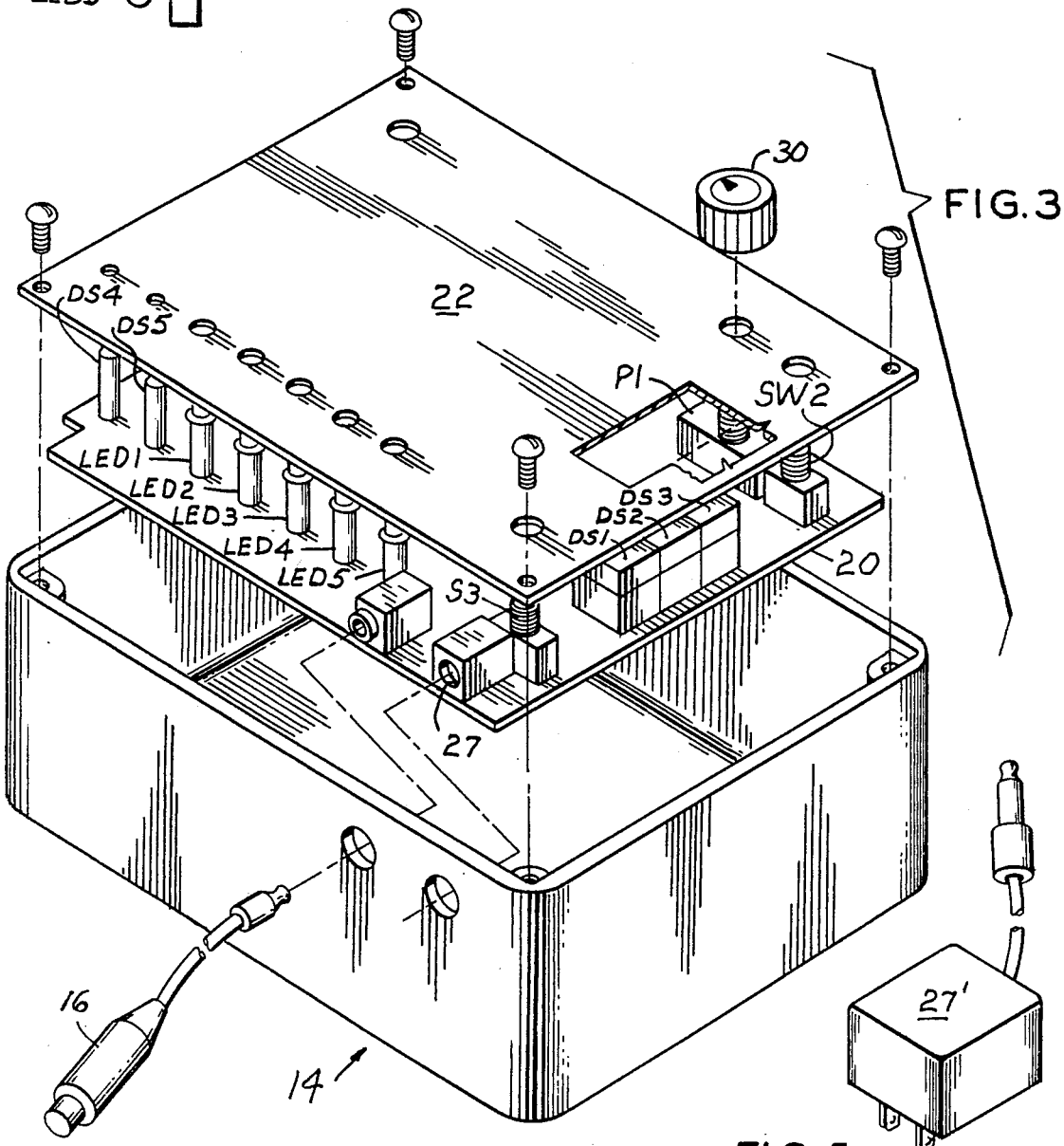
FIG.3
FIG.5

RACE DRIVER START SIGNAL REACTION TIMER

BACKGROUND OF THE INVENTION

1. Field of the invention

The present invention relates to automotive vehicle racing and more particularly to a device timing a driver's response to starting signals.

In drag racing, the vehicles are initially lined up with engines revved up and a brake holding the transmission in a locked position. Following a staging signal(s), a series of lamps are sequentially energized in equal time intervals (usually 0.5 seconds). The first three lamps are yellow with the fourth lamp being a green "start" lamp. In actual practice, a driver will try to anticipate the green lamp and begin the starting process following illumination of the last or third yellow lamp. At least three factors contribute to a delay from a "starting signal" to the instant the vehicle moves across the starting line. The first factor is the human response to a lamp or light stimulus, the second factor is the time required for the vehicle to begin to move in response to a command such as a brake or transmission release, and the third factor is the time for the vehicle to move from its staging position to cross the starting line (rollout).

The present invention measures the first factor and simulates the last two factors in a manner familiar and comfortable to a drag car driver. Thus it is apparent that the driver leaves in response to the third yellow light in a manner such that his vehicle moves across the starting line just immediately after the starting light turns green. If the driver over reacts and the vehicle crosses the starting line before the green light comes "on", then a red light (usually mounted below the green light) is activated and the driver is disqualified. In the later case, the green light is never activated.

The present invention allows a driver to practice "starts" without actual use of a vehicle and to try developing consistent reaction times. The device is reset and started by closing a switch representing a transmission brake switch. This can result in a hand-to-hand reaction in the driver. To prevent this and to force an eye-to-hand (or a eye-to-foot) reaction, a random time delay generator is incorporated between the reset operation and the beginning of the "countdown" sequence.

Drivers may use different types of starting lights depending on their classification. Most drivers use a "Standard" tree in which the above three yellow lights and one green light are energized sequentially at 0.5 second intervals. Another classification is the "PRO" tree in which the three yellow lights are lighted simultaneously and the interval between the yellow, the green and the red is 0.4 seconds. The present invention simulates either mode.

2. Description of the prior art

Prior patents relating to vehicle drag race simulators generally attempt to simulate the excitement of actual racing, such as, for example, providing roller equipped stalls which support vehicles in side by side relation. The vehicles remain in place on the rollers during a mock race with controls and dials recording engine revolutions and the equivalent miles per hour simulated by the vehicle tires.

Other prior art devices comprise relatively small manually held units which include apparatus generating vehicle noise, engine RPM and other engine noise as well as vehicle tire squeal.

Most of the prior art devices are relatively expensive and generally do not train a race driver in his reaction or response time to starting signal lamps which is accomplished by this invention.

SUMMARY OF THE INVENTION

This device comprises a relatively small unit which includes a start indicator generally referred to as a Christmas tree featuring a series of starting lamps and a disqualifying lamp. In addition to the start indicator lamps the device includes a housing containing an electronic circuit controlled by a manually closed and opened switch simulating the transmission brake of a vehicle which, if released at the proper time, avoids the red lamp disqualifying signal. The driver's response time to the starting lamp in releasing the brake switch is visually recorded using a digital display. Another feature of the circuit permits calibrating and including the vehicle response time of the driver's vehicle.

The principal objects of this invention are to obviate the need of either vehicles or replicas thereof or the moving accessories heretofore required to impart a degree of racing illusion in which starting lamps signal a start time and a circuit, under the control of the operator, measures and visually records his response to the starting lamps or visually signals his disqualification if he jumps the green start lamp; is relatively inexpensive; may be operated in any convenient location including the driver's position of a race vehicle; and permits the driver by repeatedly using the device to practice drag race starts to the extent he (or she) is able to have a consistent reaction time for releasing his transmission brake of such a value as to be better prepared at the starting line in the drag racing sport.

BRIEF DESCRIPTION OF THE DRAWINGS

FIG. 1 is an elevational view of vehicle race conventional starting lamps;

FIG. 2 is a top view, to a smaller scale, of the control/circuit housing;

FIG. 3 is a partially exploded isometric view, to a larger scale, of the control and circuit housing and certain circuit components with a portion of the housing top broken away for clarity;

FIG. 5 is an isometric view, to a different scale, of the power adaptor.

DESCRIPTION OF THE PREFERRED EMBODIMENTS

Figure 4:
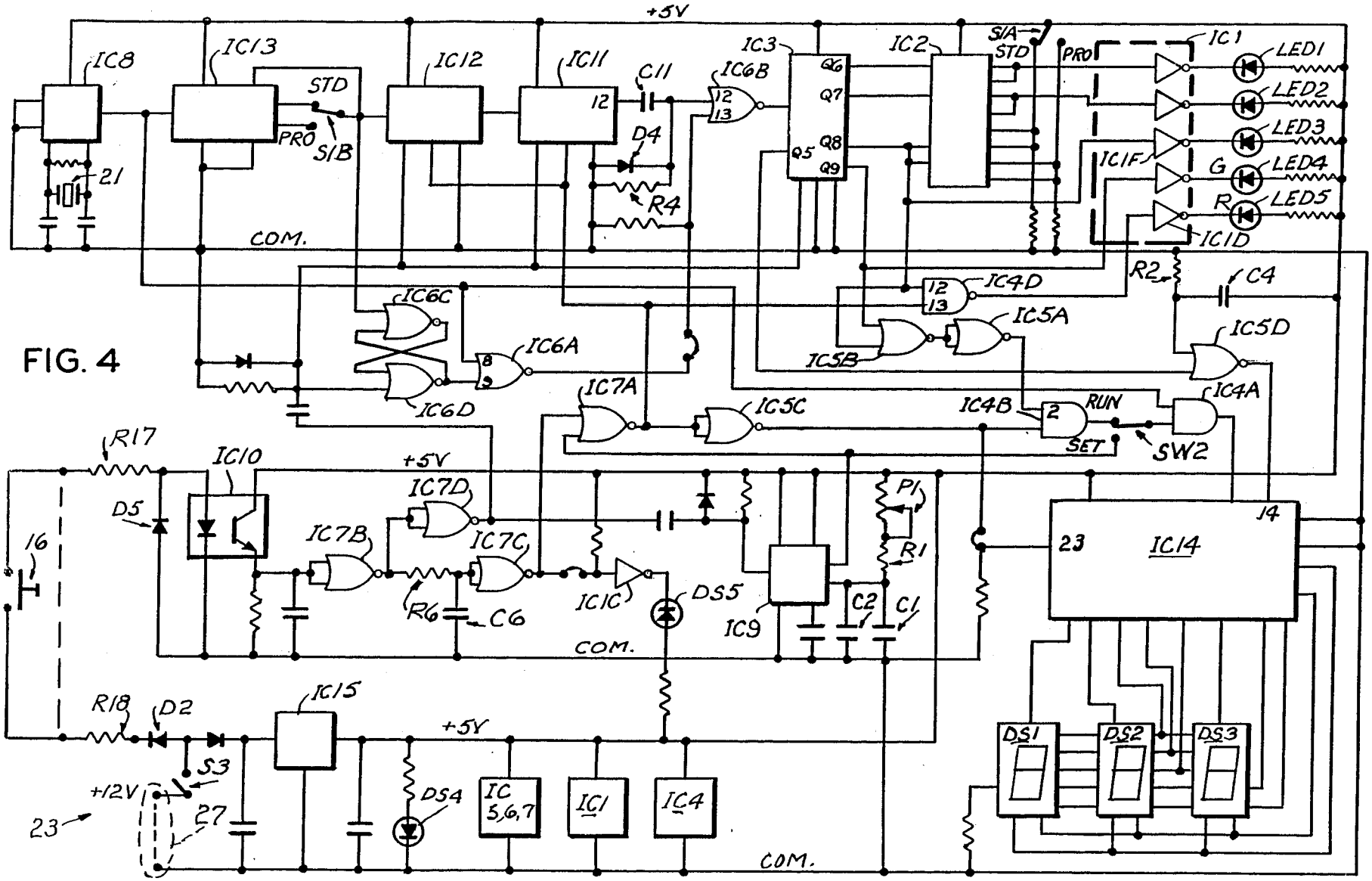
FIG. 4 is a circuit diagram.

Like characters of reference designate like parts in those figures of the drawings in which they occur.

In the drawings:

The reference numeral 10 indicates a replica of a race start indicator commonly called a "Christmas tree", hereinafter referred to as a "practice tree" comprising an upright or standard having a series (5) of vertically spaced-apart colored lamps thereon which, when energized in the manner presently described, indicate a starting signal to the drivers of a race in a conventional manner. The practice tree 10 is simulated in combination with a control box or housing 14 and a starting switch 16 representing the transmission brake release of a race vehicle as presently explained.

The housing 14 is an upwardly open box-like base containing a printed circuit board 20 attached to an apertured top or cover 22 overlying the platform and closing the housing.

The housing 14 contains a circuit 23 (FIG. 4) which will now be described. Socket 27 connects a source of electrical energy with the circuit via a conventional adaptor 27' (FIG. 5).

Referring more particularly to FIG. 4, closing the power switch S3 provides electrical potential to the circuit and energizes the practice tree pre-stage lamp DS4. The starting switch 16 is a hand held push-button type switch for connecting a positive potential to the input of an opto-coupler IC10 when the power switch S3 is closed. The hand switch 16 may be a foot operated switch, not shown, if desired. Resistors R17 and R18 and diodes D2 and D5 prevent damage to the circuit in the event the terminals for switch 16 are inadvertently connected to improper positive potentials. Operation of switch 16 appears as a logic signal at the output of NOR gate IC7B. The signal is inverted at the output of NOR gate IC7D where a positive signal indicates a closure of the operator switch 16. The output of NOR gate IC7C is like that of IC7D except for a 100 microsecond delay introduced by resistor R6 and capacitor C6. This signal is used to light the practice tree stage LED DS5, through LED driver IC1C, as presently explained.

The time base for the circuit is a crystal controlled oscillator and frequency divider IC8. The frequency of the crystal 21 is 4.096 MHz and the counter is a 12 stage binary counter, hence, the output of IC8 is a square wave of exactly 1.000 KHz.

The output of the time base IC8 is fed to cascade wired 4017 decade counters IC11, IC12 and IC13. The first counter IC13, is reset on its own Q5 or Q4 output depending on the position of a mode select switch S1B, as presently described, thereby counting by either 5 or 4. The two remaining counters IC12 and IC11 each count by ten, hence the output (pin 12) of IC11 is a pulse every 0.5 seconds for the "STD" mode or 0.4 seconds for the "PRO" mode. A very narrow pulse, about 100 microseconds, corresponding to the positive transition is created by the differentiating action of capacitor C11 and resistor R4. The negative going pulse is removed by diode clamp D4. The pulse is then inverted by NOR gate IC6B.

Pulses from NOR gate IC6B are fed into the clock input of another 4017 decade counter IC3 used as an LED lamp sequencer in which its outputs Q0 through Q9 (outputs Q0 through Q4 not shown) sequentially go high 0.5 seconds (or 0.4 seconds) for each clock input. Sequencer counter IC3 outputs Q6 and Q7 are connected to an LED driver IC1 through an analog switch IC2 energizing two yellow lamps LED 1 and LED 2 at 0.5 second intervals. Sequencer IC3 output Q8 energizes the third yellow lamp LED 3 directly through its driver IC1F. In the professional race driver or PRO mode of switch S1A sequencer output Q8 energizes all three yellow lamps. Sequencer counter IC3 is use to energize a green lamp LED 4 for a successful driver start indication. Counter IC3 outputs Q0 through Q5 are not used for energizing lamps, however, they contribute to a delay at the beginning of the countdown. This delay tends to decouple the user's response from the original closure of switch 16 and can be made to vary randomly as will be explained later.

The switch 16, which as mentioned hereinabove, represents the vehicle transmission brake switch in a race car. Closing switch 16 causes the output of NOR gate IC7D to produce a short, 100 microsecond, positive pulse to reset counters IC11, IC12 and IC3 which in turn causes LED lamps (1–5) to be deenergized and the R-S latch consisting of NOR gates IC6C and IC6D to be reset so that the output of NOR gate IC6D is low. This latch is used in generating a random delay start to be described presently. The output of NOR gate IC7C, which is the same as IC7D except for the delay introduced by resistor R6 and capacitor C6 is fed to NOR gate IC7A. The inverted signal enables the decade counters IC11 and IC12 to begin counting and ultimately deliver a train of pulses to the LED sequencer IC3.

The random delay start is generated by rapidly advancing the lamp sequencer IC3, with 0 to 4 pulses at a 1.0 millisecond rate instead of the normal 0.5 second rate. These pulses are fed to the lamp sequencer through pin 13 of NOR gate IC6B which in turn is being fed from the time base generator IC8 through pin 8 of NOR gate IC6A. Ordinarily, pin 9 of IC6A is held high, thereby preventing any pulses from the time base generator reaching the lamp sequencer IC3. Closure of the operator's switch 16 will occur at a random time compared to the 200 Hz (or 250 Hz) pulses at the output of counter IC13. Closure of switch 16 resets the R-S latch, IC6C and IC6D, so that IC6D goes low thereby allowing pulses to pass through NOR gate IC6A. Pulses will continue to pass until the next pulse from the output of counter IC13 sets the R-S latch so that IC6D goes high and the pulses passing through IC6A are blocked. Thus, the lamp sequencer IC3 has been rapidly advanced to its Q1, Q2, Q3 or Q4 position prior to being sequenced by 0.5 second pulses (or 0.4 second pulses).

The operator's switch 16 continues held closed thereby allowing the lamp sequencer IC3 to operate. When the Q5 output of the lamp sequencer (IC3) is high, the Q5 output is inverted by NOR gate IC5D in turn resetting the counter/driver IC14 (pin 14) to zero and displaying three zeros on displays DS1, DS2 and DS3. The other input at IC5D is connected to a resistor R2 and capacitor C4 in a manner to provide a "power on" reset. Pulses continue to flow from the time base generator IC8 into the 4017 decade counters IC11–IC13 and the lamp sequencer IC3. Sequencer IC3 Q6 and Q7 outputs will energize the first and second lamps LED 1 and LED 2 (standard (STD) mode only) through switches in analog switch IC2 and lamp LED drivers in IC1. As before sequencer IC3 Q8 output will energize the third yellow lamp LED 3. In the PRO mode, this signal will energize all three yellow lamps simultaneously. The sequencer Q8 signal and subsequently that from Q9 are fed into the inputs of NOR gate IC5B, inverted in NOR gate IC5A, then fed into the input, pin 2 of AND gate IC4B. When this signal appears at this input and the switch 16 is closed, the output of AND gate IC4B goes to its high state, then through switch SW2 and ultimately enabling AND gate IC4A thereby enabling the 1 KHz stream of pulses from time base generator IC8 to enter the counter/driver IC14.

The operator releases (opens) his switch 16 in response to the visual energized condition of the third yellow lamp LED 3 from sequencer IC3 output Q8. The output of NOR gate IC7D goes low triggering a 7555 IC9 vehicle delay timer keeping the output of NOR gate IC7A low, enabling the counters (IC11 and IC12) to continue operations as described hereinabove. When the vehicle delay timer IC9 times out through the resistor R1, potentiometer P1, capacitors C1 and C2, the output of IC7A goes into a high state, immediately disabling the decade counters IC11 and IC12. This high condition causes the AND gate, IC4B, to be disabled thereby blocking pulses from the time base generator from reaching the counter/driver IC14. This high condition is inverted and fed to pin 23 of the counter/driver IC14 allowing the display to be unblanked. The high condition of IC7A is also fed to pin 13 of AND gate IC4D. If this event happens before the last yellow light LED3 goes off, i.e, the Q8 output of IC3 is still high, then the red disqualification light LED 5 is energized. If the sequencer IC3 has advanced to the Q9 output, then the green light LED 4 will be energized.

Calibration Of Vehicle Response Time

To set the vehicle response time, the armature of switch S2 is placed in the "Set" or calibrate position. In this position, AND gate IC4A allows a stream of pulses from the time base generator IC8 only as long as the vehicle delay timer IC9 output is high, hence the counter/driver IC14 displays the simulated vehicle response time in digital format. The procedure is to close the operator's switch 16 and allow the sequencer IC3 to run to at least its sixth output (Q5) in order to reset the counter/driver IC14. The switch 16 is released thereby triggering the vehicle timer IC9. The potentiometer P1 is adjusted by angular rotation of its manual control 30 (FIGS. 2 and 3) until the desired delay is achieved. Thereafter switch S2 is returned to its "Operate or Run" position.

PRO Tree Option

When this option is used, the timing intervals are changed from 0.5 seconds to 0.4 seconds and the three yellow lamps (LED 1-LED 3) are simultaneously energized by the sequencer IC3 output Q7. This option is selected by placing the armatures S1A and S1B of a DPDT switch in the "PRO" position. This setting of these armatures connects the Q4 output of the first decade counter IC13 to its reset pin 15. This causes the three decade counters IC11, IC112 and IC13 to count by 400 and the clock interval to NOR gate IC6B input pin 12 to be 0.4 seconds. The armature of switch S1A changes the inputs for the first two yellow lamps LED 1 and LED 2 from the lamp sequencer IC3 to operate in parallel with the third yellow lamp LED 3.

Obviously the invention is susceptible to changes or alterations without defeating its practicability. Therefore, I do not wish to be confined to the preferred embodiment shown in the drawings and described herein.

I claim:

1. An electronic simulated racing vehicle brake release and driver start signal reaction timer, comprising:
   - a housing containing an electronic circuit connected with a source of electrical energy and including;
   - a plurality of lamps arranged in generally straight line relation and including first, second and third lamps having one color, a fourth lamp having a second color and a fifth lamp having a third color;
   - means including a counter for sequentially energizing said lamps at predetermined times starting with said first lamp through at least the fourth lamp;
   - push-button switch means simulating a racing vehicle transmission brake or wheel brake and enabling the sequential energizing means when said push-button switch means is closed and disabling the sequential energizing means when the push-button switch means is opened before a predetermined time lapse; and,
   - means including a digital display unit visually recording the time lapse between energizing said third lamp and the opening of said push-button switch means during one predetermined time period so that said fourth lamp is energized with the opening of said push-button switch when opened no sooner than at the end of said time period, but where said fifth lamp is energized with the fourth lamp inhibited by said push-button switch when said switch is opened before the expiration of said time period.

2. The reaction timer according to claim 1 in which said sequential energizing means includes:
   - an oscillator;
   - a plurality of decade counters connected in cascade with said oscillator for predetermined time spacing the electrical pulses from said oscillator;
   - a sequencer connecting the electrical pulses from said decade counters with said lamps; and,
   - a plurality of electronic switch means interposed between the sequencer and at least said fourth and fifth lamps.

3. The reaction timer according to claim 2 and further including:
   - means simulating a vehicle delay response time including a vehicle timer interposed between the push-button means and the sequencer;
   - means for adjusting the vehicle time delay to a desired value; and,
   - a series of other electronic switch means connected with said counter/driver and responsive to selected lamp energizing electrical pulses for enabling or blocking the energizing of said fifth lamp in accordance with a predetermined time lapse following energizing of said fourth lamp.

4. The reaction timer according to claim 3 and further including:
   - mode switch means interposed between said sequencer and said lamps for enabling the sequencer to simultaneously energize the first three lamps.

5. The reaction timer according to claim 4 and further including:
   - electronic signal delay means including a signal inverting latch interposed between said oscillator and said sequencer for resetting the sequencer output thereby generating a random time delay between the time of closing said push-button switch means and the start of sequentially energizing said lamps.

* * * * *